US008636433B2

(12) United States Patent
Lerner et al.

(10) Patent No.: US 8,636,433 B2
(45) Date of Patent: Jan. 28, 2014

(54) MICROBES DETECTING AND TREATING TOOTHBRUSH

(76) Inventors: Sharon Lerner, Tel Aviv (IL); Sam Lerner, Tel Aviv (IL); Uri Arbiser, D.N.Hefer (IL)

( * ) Notice: Subject to any disclaimer, the term of this patent is extended or adjusted under 35 U.S.C. 154(b) by 657 days.

(21) Appl. No.: 12/811,488

(22) PCT Filed: Jan. 8, 2009

(86) PCT No.: PCT/IL2009/000027

§ 371 (c)(1),
(2), (4) Date: Aug. 11, 2010

(87) PCT Pub. No.: WO2009/087626

PCT Pub. Date: Jul. 16, 2009

(65) Prior Publication Data

US 2010/0296859 A1 Nov. 25, 2010

Related U.S. Application Data

(60) Provisional application No. 61/019,621, filed on Jan. 8, 2008.

(51) Int. Cl.
*A46B 11/00* (2006.01)

(52) U.S. Cl.
USPC ..... 401/123; 401/183

(58) Field of Classification Search
USPC ..... 401/123, 183–186, 268, 270, 282
See application file for complete search history.

(56) References Cited

U.S. PATENT DOCUMENTS 3,723,613 A 3/1973 Block et al.
3,842,850 A * 10/1974 Sanders ..... 132/311
4,275,750 A * 6/1981 Clark ..... 132/311
4,459,277 A 7/1984 Kosti
4,530,369 A 7/1985 Adams
4,543,679 A 10/1985 Rosofsky et al.
4,717,278 A * 1/1988 Kemeny ..... 401/286
4,768,531 A * 9/1988 Broussard ..... 132/313
4,811,445 A * 3/1989 Lagieski et al. ..... 15/104.94
4,865,481 A 9/1989 Scales (Continued)

FOREIGN PATENT DOCUMENTS

GB 2019215 A 10/1979
WO 20070020660 A1 2/2007
WO 20070049298 A1 5/2007

OTHER PUBLICATIONS

Ismail, A. I., Lewis, D. W., Dingle, J. L Prevention of Periodontal Disease, in Canadian Guide to Clinical Preventive Health Care, Ottawa: Health Canada, 1994; 420-431.

*Primary Examiner* — David Walczak
(74) *Attorney, Agent, or Firm* — Marsteller & Assocites, P.C.

(57) ABSTRACT

A microbe detecting and/or treating toothbrush that includes a handle that comprises a head portion, a neck portion and a grasping portion, an upper surface and a lower surface; a plurality of bristles, positioned on and attached to the upper surface of the head portion of the handle and a dental hygiene device being parts of the handle, which comprises a dispensing aperture from which an effective amount of a disclosing and/or treating agent is dispensed and a dispensing mechanism comprising an actuator, which upon actuation, enables the dispensing aperture to provide an effective amount of a disclosing and/or treating agent, wherein the dispensing aperture and the dispensing mechanism of the dental hygiene devices are situated in the neck portion or the grasping portion of the handle.

19 Claims, 6 Drawing Sheets

(56) References Cited

U.S. PATENT DOCUMENTS

| | | | |
|---|---|---|---|
| 5,827,001 | A | 10/1998 | Taghavi-Khanghah |
| 5,832,940 | A | 11/1998 | Embry |
| 5,862,559 | A | 1/1999 | Hunter |
| 5,893,378 | A | 4/1999 | Lierena |
| 5,911,532 | A | 6/1999 | Evancic |
| 5,915,868 | A | 6/1999 | Frazell |
| 5,921,692 | A | 7/1999 | Weber |
| 6,027,273 | A | 2/2000 | Li |
| 6,050,736 | A | 4/2000 | Gonzalez |
| 6,056,466 | A | 5/2000 | Johnson |
| 6,056,469 | A | 5/2000 | Algorri |
| 6,095,710 | A | 8/2000 | Ayeni |
| 6,371,674 | B1 | 4/2002 | Lerner |
| 6,533,485 | B1 | 3/2003 | Bland |
| 7,237,974 | B2 * | 7/2007 | Pfenniger et al. ..... 401/123 |
| 2005/0232686 | A1 | 10/2005 | Zeh et al. |
| 2007/0111167 | A1 | 5/2007 | Russell et al. |

* cited by examiner

MICROBES DETECTING AND TREATING TOOTHBRUSH

FIELD OF THE INVENTION

The present invention relates to the field of toothbrushes. More particularly, it relates to a toothbrush which includes an integrated or separable dental hygiene device for the detection and/or treatment of microbes.

BACKGROUND OF THE INVENTION

Dental disease is today the most common of all human diseases worldwide. An enormous proportion of the American population suffers from dental caries (tooth decay or cavities) and periodontal (gum and bone) disease. Dental caries are virtually ubiquitous: they begin soon after teeth erupt and increase in prevalence with age. The most recent survey, conducted in 1986-7, showed that the average school-aged child has at least one cavity in permanent teeth by age 9 and 8 by age 17. Approximately one in four schoolchildren has five or more decayed, filled, or missing teeth. The average American adult has 10-17 decayed, filled or missing teeth. Furthermore, periodontal diseases are the most prevalent chronic diseases affecting children, adolescents, adults and the elderly. Approximately half of all adults in the U.S. have gingivitis (inflammation of the gums), the first stage of gum disease, and 80% have had some degree of gum inflammation that has led to the destruction of the bone which supports the teeth (periodontitis), which, as if it progresses can lead to tooth loss. Gingivitis was observed in approximately 60 percent of children, while 95% of the elderly have periodontitis. Over half of all adults over age 65 are toothless. In 1989, in the U.S., dental disease caused 51 million hours of missed school, 164 million hours of missed work and 41 million days of restricted activity. Dental expenditures in the U.S. in 1990 were over $30 billion. (U.S. Preventive Services Task Force, Guide to Clinical Preventive Services, Second Edition, 1996) In addition recent research indicates a high correlation between periodontal disease and cardiovascular disease, heart attack, stroke and low-birthweight babies.

Dental plaque is a gelatinous mass or film of bacteria within a matrix of food particles and other organic materials such as mucins. It adheres to and builds up on the surfaces of teeth and is a major cause of both dental caries and periodontal disease. Prevention of dental disease involves oral hygiene practices. Good oral hygiene includes the effective and complete removal of substantially all plaque. Plaque that remains on the teeth calcifies to form calculus or tartar. It is important to remove plaque before it calcifies into calculus that requires more extensive care for its removal, usually by a dental health professional.

Personal oral hygiene practices such as toothbrushing and flossing can prevent the development and progression of periodontal disease by removing plaque. Professional dental care alone is inadequate to prevent periodontal disease. The single most important tool for preventing dental disease is the toothbrush. In the absence of personal plaque removal, after 10 to 21 days, gingivitis develops in healthy adults. This provides strong evidence for the recommendations for at least daily toothbrushing. Other studies confirmed that effective plaque removal every 48 hours was associated with gingival health. The efficacy of personal oral hygiene measures though is dependent upon the ability of the patient to do them effectively, that is to keep the teeth adequately plaque-free. Due to the difficulty many patients have in adopting and maintaining good oral hygiene habits these measures often fail to remove plaque adequately and prevent gum disease. (U.S. Preventive Services Task Force, Guide to Clinical Preventive Services, Second Edition, 1996, and Ismail, A. I., Lewis, D. W., Dingle, J. L. Prevention of Periodontal Disease, in Canadian Guide to Clinical Preventive Health Care, Ottawa: Health Canada, 1994; 420-431). It is important that the patient continue to be motivated to maintain oral hygiene habits. It is important for oral health professionals to counsel patients about the importance of oral hygiene habits and to instruct them in the guidelines for proper effective toothbrushing.

It is also often difficult for the patient to ensure that plaque removal is complete because the patient cannot easily determine (either visually or otherwise) whether all the plaque has been removed. Plaque is translucent or tooth-colored and not therefore visible. This problem can be surmounted through the use of a dental hygiene device which incorporates, for instance, an oral compbsition comprising chemical disclosing agents.

These chemical agents have been used for over 80 years and generally consist of a dye that stains only the plaque and renders it visible in contrast to other oral structures. Chemical disclosing agents come in a variety of forms including solutions that can be topically applied by dental personnel or with which the patient rinses, as well as chewable tablets, lozenges, wafers and powders. A variety of substances have been used as chemical disclosing agents including iodine, basic fuchsin neutral red, erythrosine (e.g., FDC Red No. 3), and others. Some dyes used in the past have had a number of limitations including that they were suspected carcinogens, appeared in the urine or had an unpleasant taste. An appropriate dye should not be long lasting, should be easily removed and should not stain the skin or mucosa to any significant extent. It should not only have a pleasing shade but also allow for effective contrast with surrounding oral tissues. Some dental health professionals feel that a minor drawback to the use of the popular FDC Red No. 3 is that it has poor contrast with oral tissues such as the gingivae. Brown dyes have an unappealing appearance and have been found to be distasteful to users. Some disclosing agents are mixtures of two dyes that further reveal the age and thickness of the plaque. Such an agent is taught in U.S. Pat. No. 3,723,613. The agents disclosed are mixtures of dyes such as FDC Red No. 3 and either FDC Blue No. 1, FDC Green No. 3 or Hercules Green Shade 3. These allow for the differential staining of thin and thick plaque, whereby the thin plaque is stained red and the thicker blue or green.

Patients are usually instructed to brush their teeth in their usual manner and then disclose any remaining plaque through use of the chemical disclosing agent. Then they can brush again until all the stained areas of plaque have been removed. Use of chemical disclosing agents is very effective also for counseling and educating patients in the proper techniques for brushing and plaque removal and for motivating patients to maintain their oral hygiene habits. In British Patent No. 2019215 to Frysh it is taught that a chemical disclosing agent may be included in a dentifrice or toothpaste. The chemical disclosing agent in the Frysh patent includes mixtures of dye that result in the plaque being disclosed as a green color, and the preferred agent was formed by a mixture of Sulphan Blue and Tartrazine Yellow. A plaque disclosing dentifrice containing a mixture of dyes is also taught in U.S. Pat. No. 4,459,277 and in U.S. Pat. No. 5,862,559.

It has been recognized that proper oral hygiene habits are often neglected. Reasons for this include that it is often perceived as time consuming and inconvenient. It requires storing, carrying, ending and having available both toothbrush and dentifrice (toothpaste). For these reasons the prior art is crowded with many descriptions of toothbrush devices which store and dispense toothpaste in an attempt to address these problems. Several are also adapted to dispense other oral hygiene products such as dental floss. Known prior art combination toothpaste dispensing toothbrushes include U.S. Pat. No. 4,865,481, U.S. Pat. No. 5,827,001, U.S. Pat. No. 5,832,940, U.S. Pat. No. 5,911,532, U.S. Pat. No. 5,915,868, U.S. Pat. No. 5,921,692, U.S. Pat. No. 6,027,273, U.S. Pat. No. 6,056,466, U.S. Pat. No. 6,050,736, U.S. Pat. No. 6,056,469, and U.S. Pat. No. 6,095,710. The devices heretofore devised are known to consist basically of familiar, expected and obvious structural configurations, notwithstanding the myriad of designs encompassed by the crowded prior art which have been developed for the fulfillment of countless objectives and requirements. There are fine differences among them employed to distinguish the inventions from one another and to overcome associated problems. Because toothpaste is a viscous substance, most have specialized dispensing mechanisms such as screw driven pistons suitable for delivering this type of substance. All deliver the dentifrice onto the brushhead and bristles. Other individualized features relate to whether the toothbrush is meant to be of limited use and economically disposable or alternatively refillable and reusable. Many of these toothbrushes suffer from disadvantages including that they have complex mechanical features, do not resemble a conventional toothbrush, and are meant for only single or very limited number of uses.

Using a chemical disclosing agent is also inconvenient for the individual as the separate container of disclosing agent must be stored, found and used. One toothbrush device designed for dispensing a chemical disclosing agent is described in U.S. Pat. No. 4,543,679 to Rosofsky et al. The device of Rosofsky et al. is a toothbrush wherein an oral hygiene device can be attached to the tail end of the handle. The oral hygiene devices taught by Rosofsky et al. include a porous pad, which can hold a chemical disclosing agent, or a reservoir that can hold a dry powder or solid form of a chemical disclosing agent. This device does not hold a solution of disclosing agent and is not useful for convenient multiple applications without re-immersion of the pad in the agent.

Applicator devices with simple mechanical systems for applying oral composition are disclosed for example in US 2005/0232686 (Zeh et al). The devices of Zeh et al. include a disposable flexible container configured to hold an oral composition and an applicator tip member couple to the open end of the container used for dispensing the composition. The composition is flown from the flexible container to the head of the applicator member by applying a simple pressure on the side of the container, thereby conveying the oral composition to the open end of the head.

A further device of relevance is taught in U.S. Pat. No. 6,371,674 to Lerner, which is hereby incorporated by reference in its entirety. The Lerner device is a toothbrush with storage and dispensing arrangement for plaque disclosing solution which releases drops of the solution from the rear side of the toothbrush head.

The aforementioned devices suffer from a number of shortcomings. Firstly, chemical disclosing agents are, by their very nature, strongly colored dyes which cause unwelcome staining if they fall on skin tissue or other objects unintentionally, and may even cause damage to clothing or other objects onto which it falls. It has been found that the dispensing arrangements of Rosofsky et al. and Lerner do not provide sufficient precision of application of the chemical disclosing agent to avoid the aforementioned soiling.

Furthermore, particularly with reference to the Lerner device, it is noted that the head of the toothbrush is a region exposed to immersion in saliva and toothpaste during normal use of the toothbrush, and is therefore prone to blockage. It would also be considered advantageous from the point of view of hygiene if the disclosing agent dispensing mechanism was a non-contact dispensing mechanism which did not need to contact tissue surfaces within the mouth during application of the disclosing agent.

Finally, reference is also made to WO2007/049298 and WO2007/020660 which both teach a toothbrush with a spray dispenser for dentifrice and the like located beneath the bristles of the toothbrush head. Here too, the spray dispenser is at risk of becoming blocked due to repeated exposure to saliva and toothpaste. It is also likely that at least part of the spray will fall on the bristles themselves, causing soiling of the bristles, possible dripping of excess liquid from the bristles, and consequent wastage of the liquid sprayed.

It is therefore an object of the invention to provide a toothbrush comprising a dental hygiene device for disclosing oral microbes, which overcomes the above-mentioned shortcomings of the prior art devices.

It is a further object of the invention to provide a toothbrush comprising a dental hygiene device, which enables a precise application of the microbe disclosing agents.

It is another object of the invention to provide a toothbrush comprising a dental hygiene device for disclosing and treating dental diseases.

It is still another object of the present invention to provide a toothbrush comprising several dental hygiene devices, each of these devices being able to prkisely deliver disclosing or treating agents.

Other objects and advantages of the present invention will appear as the description proceeds.

SUMMARY OF THE INVENTION

The present invention is directed to a microbe detecting and/or treating toothbrush that includes a handle that comprises a head portion, a neck portion and a grasping portion, an upper surface and a lower surface; a plurality of bristles, positioned on and attached to the upper surface of the head portion of the handle; and one or more dental hygiene devices being parts of the handle. The devices comprise:

- a dispensing aperture from which an effective amount of a disclosing and/or treating agent is dispensed; and
- a dispensing mechanism comprising an actuator, which upon actuation, enables the dispensing aperture to provide an effective amount of a disclosing and/or treating agent, wherein the dispensing aperture and the dispensing mechanism of the dental hygiene devices are situated in the neck portion or the grasping portion of the handle.

At least one of the dental hygiene devices may be non-removable. At least one of the dental hygiene devices may be removable and becomes part of the handle when combined with the toothbrush. At least one of the dental hygiene devices may comprise an actuator which is hidden inside the handle of the toothbrush when the device is attached to be part of the handle.

At least one of the dental hygiene devices may comprise a dispensing aperture situated on the surface of the grasping portion of the handle of the toothbrush. At least one of the dental hygiene devices may comprise a dispensing aperture situated on the surface of the neck portion of the handle of the toothbrush.

At least one of the dental hygiene devices may have the actuator protected by an arched portion of the handle or by a removable cover.

A toothbrush according to claim 1, wherein at least one of the dental hygiene devices comprises a dispensing aperture protected by a removable cover.

The dental hygiene devices may also be a spray nozzle, a precision dripper, an illuminating device comprising a light emitting diode.

The dental hygiene devices may comprise a dental plaque disclosing agent, a dental microbial treatment agent, in the form of a chemical composition. The agent may be a physical agent.

The agent may be an oral health composition, an oral hygiene composition, a cosmetic application such as a dentifrice, cleaning or polishing agent, a mouthwash, a breath freshener, an antibacterial agent, an antiviral agent, an oral medication and a composition for therapeutic treatment.

BRIEF DESCRIPTION OF THE DRAWINGS

The above and other characteristics and advantages of the invention will be more readily apparent through the following examples, and with reference to the appended drawings, wherein.

DETAILED DESCRIPTION OF THE INVENTION

The present invention is a toothbrush comprising one or more dental hygiene devices used for disclosing the presence of dental microbes and/or treating these microbes, in mouth specific locations. The principles and operation of toothbrushes according to the present invention may be better understood with reference to the drawings and the accompanying description.

By way of introduction, the present invention provides a number of novel features, each of which is believed to be of patentable significance, and which can be combined in various combinations. A selection of the combinations will be described below, and other possible combinations will be clear to one ordinarily skilled in the art on the basis of this description. All features described below in the context of one exemplary embodiment of the present invention should be understood as being equally applicable to other embodiments except where the features are clearly incompatible or it is explicitly stated otherwise. In particular, it should be noticed that, for the seek of clarity, the following exemplary embodiments only describe toothbrushes of the invention with a single dental hygiene device. However, it should be understood that the instant invention also encompasses toothbrushes having multiple dental hygiene devices, each of them being able to dispense identical or different disclosing or treating agents. In a particular embodiment, the toothbrush of the invention comprises a handle with a plurality of bristles in the head portion, and two dental hygiene devices included in the grasping portion of the handle. One of these devices is detached from the handle and is used to dispense a first agent to the teeth, whereas the second device, which cannot be removed from the handle, is used to dispense a second agent to the teeth.

As used herein, the term "disclosing agent" means all types of chemical compositions of in any suitable form (e.g. liquid, gel, powder, etc.), or radiations, able to reveal the presence of microbes.

As used herein, the term "treating agent" means all types of chemical compositions of in any suitable form (e.g. liquid, gel, powder, etc.), or radiations, able to help removing microbes.

As used herein, the term "dental hygiene device" is a device used for preventing, diagnosing, improving or treating dental diseases, including any device that is based on illumination or radiation.

Figure 1C:
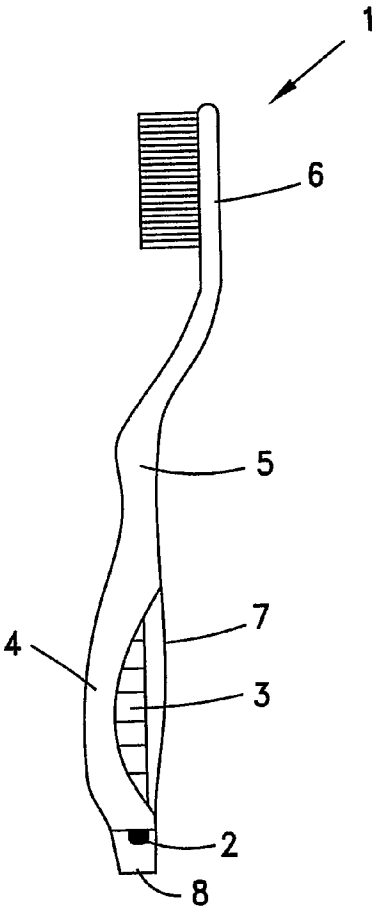
FIGS. 1A-1C show two perspective views and one side view of an embodiment of the toothbrush of the invention, which comprises a non-removable dental hygiene device and a detachable protective cover.
Figure 1B:
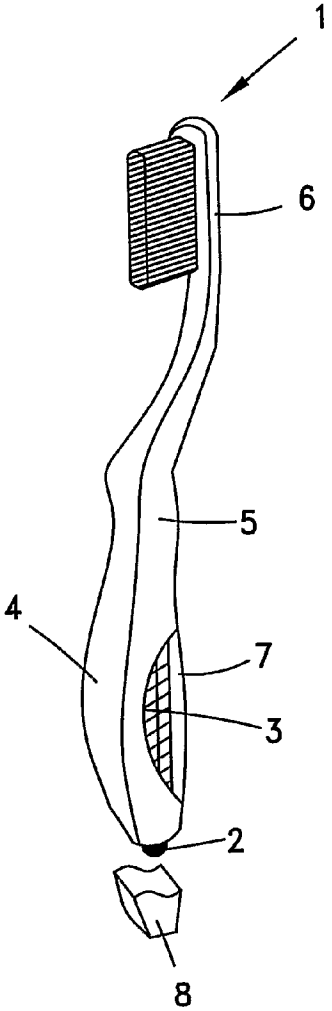
Figure 1A:
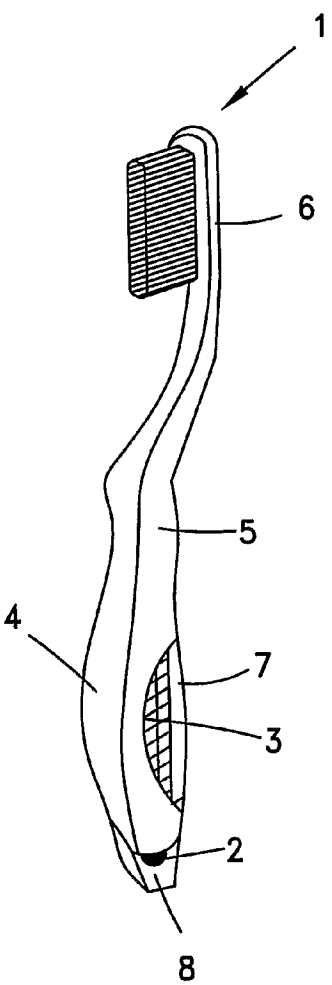

Referring now to the drawings, FIGS. 1A-1C show views of a first embodiment of a toothbrush 1, constructed and operative according to the teachings of the present invention. It is a particular feature of the present embodiment and certain other embodiments of the invention, that the plaque disclosing agent is dispensed via a spray nozzle 2. This allows hygienic non-contact application of the disclosing agent to the teeth while at the same time providing accurate delivery to the desired location with minimum soiling.

The spray nozzle 2 is preferably a directional nozzle with only a small degree of divergence. In the case illustrated here, the plaque disclosing agent is stored in a reservoir 3 within the body of the toothbrush handle 4 and the spray nozzle 2 is provided near the rear end of the handle. Although this location is believed to be advantageous, other positions of the spray nozzle 2 are possible, for example, elsewhere in the handle 4 or neck 5 of the toothbrush. However, as mentioned above, it is preferable that the spray nozzle is not in the head portion 6 of the toothbrush to avoid constant exposure to saliva and toothpaste. Ejection of the plaque disclosing agent through the spray nozzle may be achieved by any suitable mechanism. In one preferred implementation, a pump mechanism is actuated by depressing the spray nozzle 2. Such pump mechanisms are well known in the field of perfumes and cosmetics, and allow accurate dispensing of small quantities of solution. Alternatively, the reservoir 3 may be pre-pressurized, or may be pressurized by pressure of the user's finger against a displaceable or flexible region 7 of the toothbrush handle 4. In the embodiment illustrated here, a protective cover 8 is provided to prevent unintentional actuation of the spray nozzle 2 during handling of the toothbrush. Most preferably, the protective cover 8 conforms to the outer surfaces of the toothbrush handle, making the toothbrush convenient to use in the conventional manner without concern of accidental soiling from the disclosing agent. Optionally, the protective cover 8 may be interconnected with the toothbrush handle 4, for example, via an integral hinge (not shown), to ensure that the cover 8 is not lost.

In the present embodiment and other embodiments of the invention, the plaque disclosing agent may be any suitable disclosing agent such as, but not limited to, the examples discussed above in the background section of this document. In certain cases, a disclosing agent responsive to illumination (e.g., fluorescent under certain wavelengths of illumination) may be used. In such cases, illuminating or radiating means, such as a LED of suitable wavelength together with a switchable electric power source is preferably incorporated into the same or another dental hygiene device, incorporated into the toothbrush of the invention.

Figure 2B:
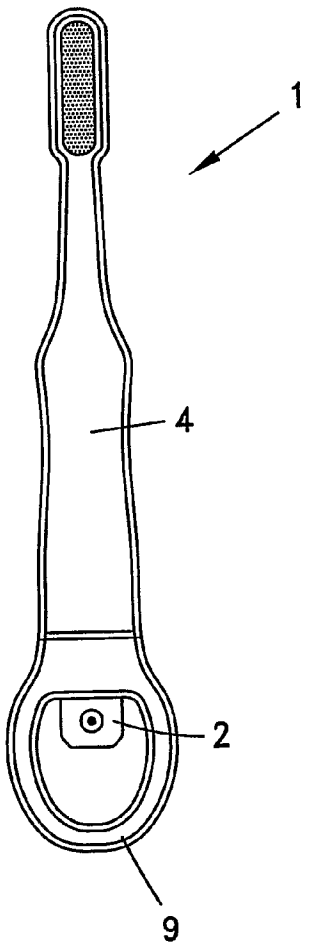
FIGS. 2A and 2B show one perspective view and one front view of an embodiment of the toothbrush of the invention, which comprises a non-removable spray nozzle dental hygiene device and an arched portion in the toothbrush handle.
Figure 2A:
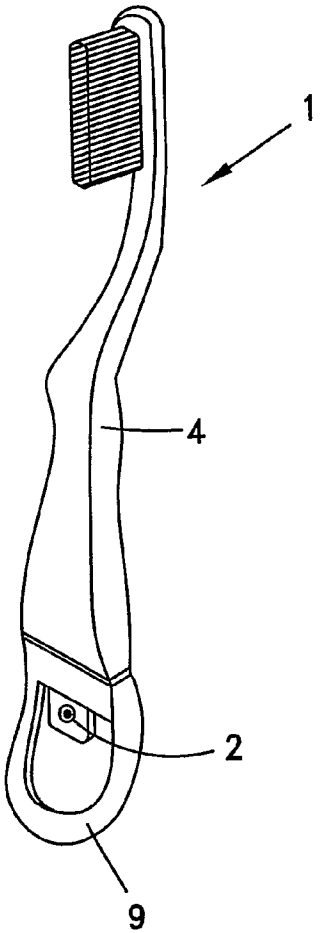

Turning now to FIGS. 2A and 2B, these show an alternative embodiment of a toothbrush 1, constructed and operative according to the teachings of the present invention. This embodiment is almost similar in structure and function to that of FIGS. 1A-1C. However, in this case, instead of a removable cover, the spray nozzle 2 is protected against unintentional actuation through being located in an aperture formed within the handle 4 of the toothbrush 1. An arched portion 9 of the handle 4 passes over the spray nozzle 2, leaving space for insertion of a finger to actuate the nozzle 2 but protecting the nozzle from accidental pressure from nearby objects. This has the advantage that there is no cover to be lost.

Figure 3C:
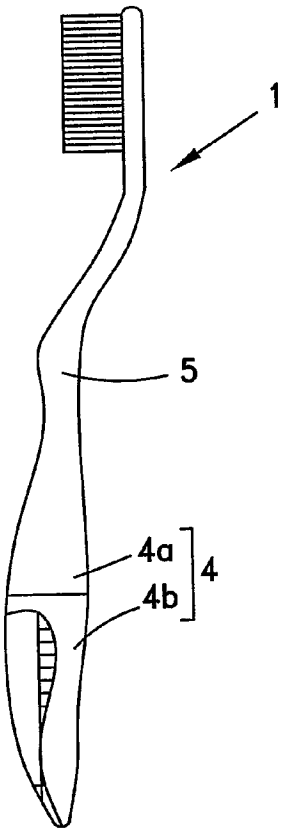
FIGS. 3A-3C show two perspective views and one side view of an embodiment of the toothbrush of the invention, which comprises a separable dental hygiene device fitting into the toothbrush handle, to become part of said handle.
Figure 3B:
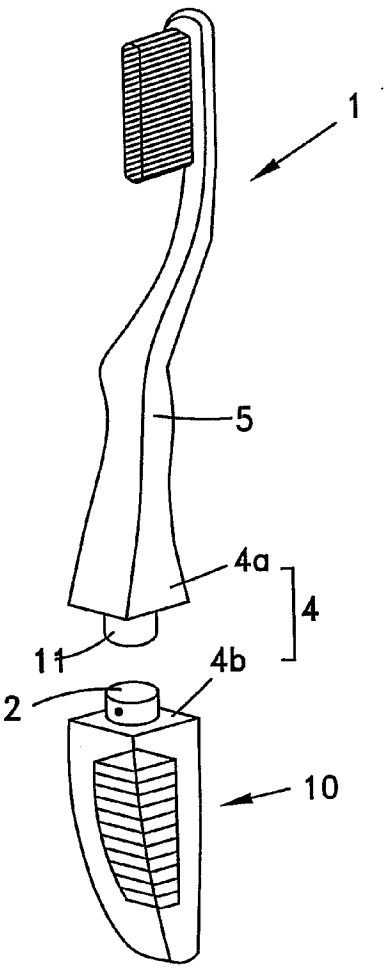
Figure 3A:
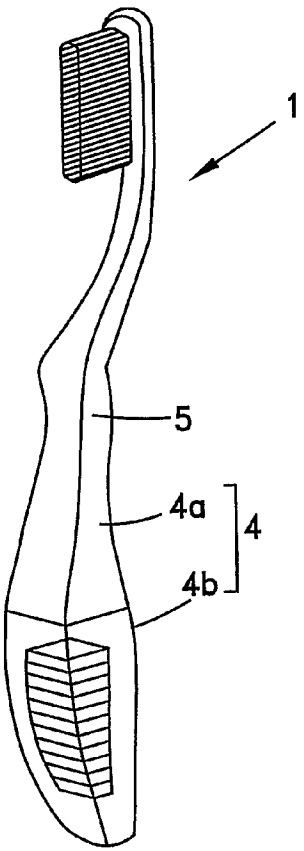

Turning now to FIGS. 3A-3C, there is shown a third embodiment of a toothbrush, constructed and operative according to the teachings of the present invention. In this embodiment, the toothbrush handle 4 is composed of two parts, namely one upper part 4*a* and one lower part 4*b*. Hence, this embodiment provides a separable dental hygiene device 10 which mates with an especially adapted toothbrush handle upper part 4*a* and become part of this handle. Engagement between the dental hygiene device 10 and the handle upper part 4*a* may be through any suitable form of engagement including, but not limited to, threaded engagement, a resilient clipping mechanism, a bayonet engagement and simple frictional engagement. Optionally, the separable dental hygiene device 10 may form most or all the handle 4 of the assembled toothbrush, i.e., mating directly with the neck portion 5 of the toothbrush. Most preferably, the spray nozzle 2 is provided on a region of the dental hygiene device 10 which is covered when the dental hygiene device 10 and handle upper part 4*a* are engaged. In the preferred case shown here, the spray nozzle 2 is received in a corresponding hollow space 11 formed in the toothbrush handle upper part 4*a*. This prevents unintentional actuation of the spray nozzle 2. In other respects, the structure and function of the separable dental hygiene device 10 of FIGS. 3A-3C is analogous to the integrated dental hygiene device 10 of FIGS. 1A-1C.

Figure 4:
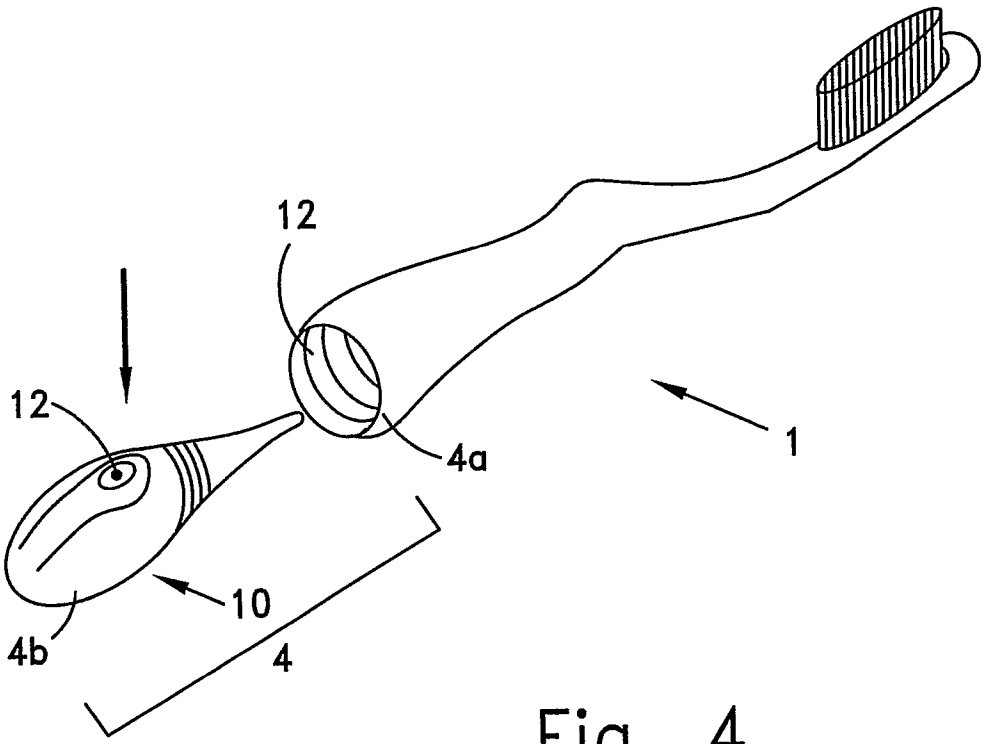
FIG. 4 shows a perspective view of one embodiment of the toothbrush of the invention, which comprises a separable precision dripper dental hygiene device fitting into the toothbrush handle, to become part of said handle.

Turning now to FIG. 4, it will be appreciated that the concept of a separable disclosing agent dental hygiene device mating with a toothbrush to function as part of the handle may be implemented to advantage in various ways, even without the aforementioned spray nozzle. By way of example, FIG. 4 shows an embodiment of a toothbrush 1, constructed and operative according to the teachings of the present invention, in which a separable precision dripper dental hygiene device 10 is provided to function as part of the toothbrush handle 4 when the dental hygiene device 10 is not in use. The dental hygiene device 10 preferably has a metered dose drop release mechanism, typically operated by a push-button mechanism 12 as shown. When not in use, the dental hygiene device 10 mates with the handle upper part 4*a*, for example, via the threaded engagement configuration 12 as illustrated here, and functionally becomes part of the toothbrush handle 4.

Figure 5:
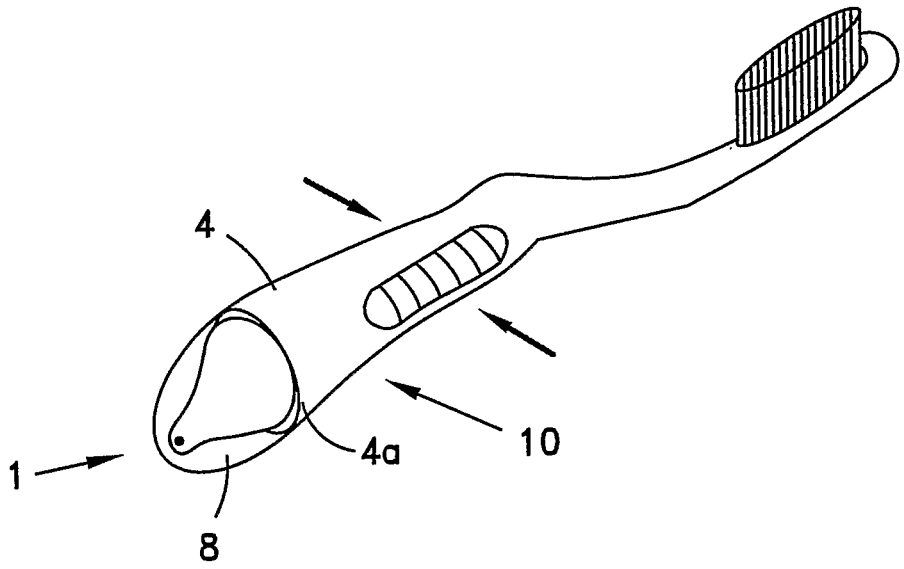
FIG. 5 shows a perspective view of one embodiment of the toothbrush of the invention, which comprises a metered-dose drop release dental hygiene device integrated into the toothbrush handle and having a protective cover.

FIG. 5 shows a metered-dose drop release dental hygiene device 10, similar to that of FIG. 4, integrated into the handle 4 of the toothbrush 1. In this case, a protective cover 8 is preferably provided to protect the drop-releasing aperture when not in use.

Figure 6:
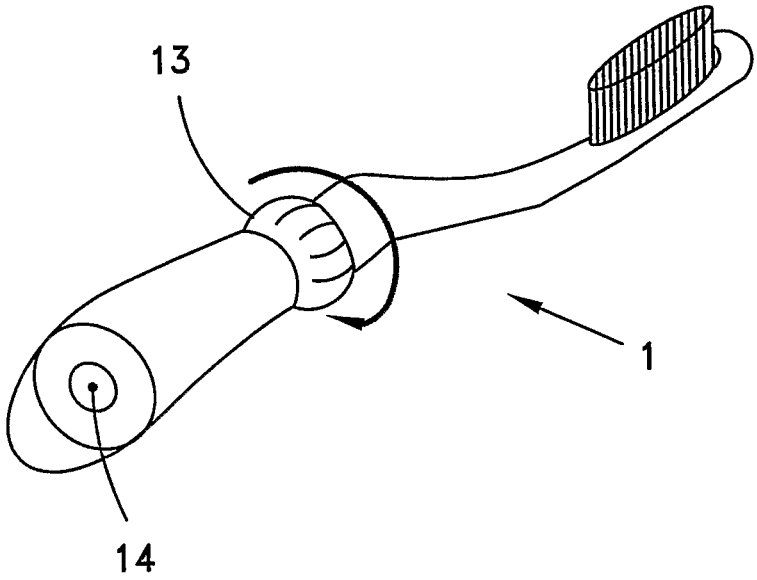
FIG. 6 shows a perspective view of one embodiment of the toothbrush of the invention, which comprises a non-removable dental hygiene device with a screw mechanism with an actuator ring.

Turning finally to FIG. 6, this shows an alternative embodiment of the toothbrush 1 of the present invention present invention particularly suited to plaque disclosing agents in gel or powder form. In this case, a screw mechanism with an actuator ring 13 similar to that used in stick-deodorants is provided to advance the disclosing agent to a dispensing aperture 14 located, in this case, near the tip of the toothbrush handle 4. This arrangement provides a well-controlled quantity of the disclosing agent as a function of the angle through which the actuator ring is turned.

The aperture(s) of the dental hygiene device may also be located at any place on the head portion, on the neck portion or on the grasping portion.

Although the above embodiments have all been presented in an exemplary case of applying a plaque disclosing agent, it should be noted that the novel aspects of these toothbrush and dental hygiene device combinations may also be used to advantage with other oral hygiene products including, but not limited to, antibacterial agents, breath freshening agents, medications and cosmetic compositions.

It will be appreciated that the above descriptions are intended only to serve as examples, and that many other embodiments are possible within the scope of the present invention as defined in the appended claims.

The invention claimed is:

1. A microbe detecting and/or treating toothbrush comprising:

a) a handle that comprises a head portion, a neck portion and a grasping portion, an upper surface and a lower surface;

b) a plurality of bristles, positioned on and attached to said upper surface of said head portion of said handle; and c) one or more dental hygiene devices being pans of said handle and adapted to precisely deliver a metered dose of a disclosing agent or a treating agent to the teeth, said devices comprising:

c.1) a dispensing aperture for dispensing a metered dose of a disclosing or treating agent; and c.2) a dispensing mechanism comprising an actuator, which upon actuation, enables the dispensing aperture to precisely deliver a metered close of a disclosing agent or a treating agent to the teeth;

wherein said dispensing aperture and said dispensing mechanism of said dental hygiene devices are situated in said grasping portion of said handle.

2. A toothbrush according to claim 1, wherein at least one of said dental hygiene devices is non-removable.

3. A toothbrush according to claim 1, wherein at least one of said dental hygiene devices is removable and becomes pail of the handle when combined with the toothbrush.

4. A toothbrush according to claim 3, wherein at least one of said dental hygiene devices comprises an actuator which is hidden inside the handle of said toothbrush when said device is attached to be part of said handle.

5. A toothbrush according to claim 1, wherein said at least one of said dental hygiene devices comprises a dispensing aperture situated on the surface of the grasping portion of the handle of said toothbrush.

6. A toothbrush according to claim 1, wherein at least one of said dental hygiene devices has said actuator protected by an arched portion of the handle.

7. A toothbrush according to claim 1, wherein at least one of said dental hygiene devices has said actuator protected by a removable cover.

8. A toothbrush according, to claim 1, wherein at least one of said dental hygiene devices comprises a dispensing aperture protected by a removable cover.

9. A toothbrush according to claim 1, wherein at least one of said dental hygiene devices is a spray nozzle.

10. A toothbrush according to claim 1, wherein at least one of said dental hygiene devices is a precision dripper.

11. A toothbrush according, to claim 1, wherein at least one of said dental hygiene devices is an illuminating device comprising a light emitting diode.

12. A toothbrush according to claim 1, wherein at least one of said dental hygiene devices further comprises a dental plaque disclosing agent.

13. A toothbrush according to claim 12, wherein said agent is a chemical composition.

14. A toothbrush according to claim 12, wherein said agent is a physical agent.

15. A toothbrush according to claim 12, wherein said agent is selected from the group consisting of an oral health composition, an oral hygiene composition, a cosmetic application such as a dentifrice, cleaning or polishing agent, a mouthwash, a breath freshener, an antibacterial agent, an antiviral agent, an oral medication and a composition for therapeutic treatment.

16. A toothbrush according to claim 1, wherein at least one of said dental hygiene devices further comprises a dental microbial treatment agent.

17. A toothbrush according to claim 16, wherein said agent is a chemical composition.

18. A toothbrush according to claim 16, wherein said agent is a physical agent.

19. A toothbrush according to claim 16, wherein said agent is selected from the group consisting of an oral health composition, an oral hygiene composition, a cosmetic application such as a dentifrice, cleaning or polishing agent, a mouthwash, a breath freshener, an antibacterial agent, an antiviral agent, an oral medication and as composition for therapeutic treatment.

* * * * *

UNITED STATES PATENT AND TRADEMARK OFFICE

CERTIFICATE OF CORRECTION

PATENT NO. : 8,636,433 B2
APPLICATION NO. : 12/811488
DATED : January 28, 2014
INVENTOR(S) : Sharon Lerner, Sam Lerner and Uri Arbiser It is certified that error appears in the above-identified patent and that said Letters Patent is hereby corrected as shown below:

In the Specification

Column 1, line 41, the text "low-birthweight" should be changed to --low birthweight--.

Column 1, lines 63-65, the text "The efficacy of personal oral hygiene measures though is dependent upon the ability of the patient to do them effectively, that is to keep the teeth adequately plaque-free." should be changed to --The efficacy of personal oral hygiene measures is however dependent upon the ability of the patient to do them effectively, or in other words, to keep the teeth adequately plaque-free.--.

Column 2, line 27, the text "fuchsin neutral red" should be changed to --fuchsine, neutral red--.

Column 3, lines 20-21, the text "brush-head" should be changed to --brush head--.

Column 7, line 44, the text "respects" should be changed to --aspects--.

In the Claims

Column 8, line 33 (Claim 1), the text "pans" should be changed to --parts--.

Column 8, line 41 (Claim 1), the text "close" should be changed to --dose--.

Column 8, line 49 (Claim 3), the text "pail" should be changed to --part--.

Column 8, line 55 (Claim 5), the text "wherein said at least" should be changed to --wherein at least--.

Signed and Sealed this
Twenty-fourth Day of February, 2015

Michelle K. Lee

Michelle K. Lee
*Deputy Director of the United States Patent and Trademark Office*